US006786824B2

(12) United States Patent
Cannon

(10) Patent No.: US 6,786,824 B2
(45) Date of Patent: Sep. 7, 2004

(54) METHOD, APPARATUS, AND SYSTEM FOR PROVIDING A PLAYER WITH OPPORTUNITIES TO WIN A FEATURE EVENT AWARD

(75) Inventor: Lee E. Cannon, Bozeman, MT (US)

(73) Assignee: IGT, Reno, NV (US)

( * ) Notice: Subject to any disclaimer, the term of this patent is extended or adjusted under 35 U.S.C. 154(b) by 0 days.

(21) Appl. No.: 09/866,388

(22) Filed: May 25, 2001

(65) Prior Publication Data

US 2002/0177483 A1 Nov. 28, 2002

(51) Int. Cl.[7] ..... A63F 9/24

(52) U.S. Cl. ..... 463/42; 463/16; 463/25; 463/29

(58) Field of Search ..... 463/17, 20, 16, 463/25, 29, 42

(56) References Cited

U.S. PATENT DOCUMENTS

| | | | | |
|---|---|---|---|---|
| 4,339,798 A | | 7/1982 | Hedges et al. | 364/412 |
| 4,582,324 A | | 4/1986 | Koza et al. | 273/138 |
| 4,669,731 A | | 6/1987 | Clarke | 273/143 |
| 4,679,143 A | | 7/1987 | Hagiwara | 364/412 |
| 4,695,053 A | | 9/1987 | Vazquez, Jr. et al. | 273/143 |
| 4,817,951 A | | 4/1989 | Crouch et al. | 273/143 |
| 4,837,728 A | | 6/1989 | Barrie et al. | 364/412 |
| 4,871,171 A | | 10/1989 | Rivero | 273/138 |
| 5,083,271 A | | 1/1992 | Thacher et al. | 364/411 |
| 5,152,529 A | | 10/1992 | Okada | 273/143 |
| 5,186,460 A | | 2/1993 | Fongeallaz et al. | |
| 5,242,163 A | | 9/1993 | Fulton | 273/85 |
| 5,265,874 A | | 11/1993 | Dickinson et al. | |
| 5,275,400 A | * | 1/1994 | Weingardt et al. | 463/12 |
| 5,288,081 A | | 2/1994 | Breeding | 273/292 |
| 5,290,033 A | | 3/1994 | Bittner et al. | 273/138 |
| 5,393,057 A | | 2/1995 | Marnell, II | 273/85 |
| 5,397,125 A | | 3/1995 | Adams | 273/138 |
| 5,417,430 A | | 5/1995 | Breeding | 273/292 |

(List continued on next page.)

FOREIGN PATENT DOCUMENTS

| | | |
|---|---|---|
| WO | WO 98/00210 | 1/1998 |
| WO | WO 00/20082 | 4/2000 |
| WO | WO 02/096528 | 12/2002 |

OTHER PUBLICATIONS

Scarne,Scarne's New Complete Guide to Gambling, 1974, Slmon & Schuster, 162–167.*

Take Your Pick, Strictly Slots (Mar. 2001).

Instant Slotto, Strictly Slots (Apr. 2001).

EZ–Pay Ticket System Brochures, IGT (at least 2000).

IGT Gaming System Brochures, IGT (at least 2001).

Raining Diamonds Advertisement, Sierra Design Group (2001).

Silver Strike Advertisement and Pictures, Anchor Gaming (1997).

*Primary Examiner*—Jessica Harrison
*Assistant Examiner*—Corbett B Coburn
(74) *Attorney, Agent, or Firm*—Marshall, Gerstein & Borun LLP

(57) ABSTRACT

A method of gaming and related gaming devices and systems. A base, or primary game is employed wherein qualification for an additional feature event is based upon one or more predetermined activities associated with the primary game. The primary game may include a slot machine type game, video poker, or other electronic or electromechanical type gaming machines. The feature event wagering opportunity for which qualification is sought to be earned by a player may include a live contest, a reenacted live contest, or what is termed herein a future feature contest. Banks of machines may be networked for qualified participation in the feature event and such networking may include the linking of machines at remote locations and even the inclusion of gaming conducted via the Internet.

77 Claims, 4 Drawing Sheets

U.S. PATENT DOCUMENTS 5,472,197 A 12/1995 Gwiasda et al. ..... 273/143
5,544,892 A 8/1996 Breeding ..... 273/292
5,560,603 A 10/1996 Seelig et al.
5,564,701 A * 10/1996 Dettor ..... 463/16
5,580,309 A 12/1996 Piechowiak et al. ..... 463/16
5,611,730 A * 3/1997 Weiss ..... 463/20
5,645,486 A 7/1997 Nagao et al.
5,655,961 A 8/1997 Acres et al. ..... 463/27
4,856,787 A 9/1997 Itkis ..... 273/23
5,664,998 A 9/1997 Seelig et al.
5,758,875 A 6/1998 Giacalone, Jr. ..... 273/143
5,761,647 A * 6/1998 Boushy ..... 705/10
5,769,716 A 6/1998 Saffari et al.
5,779,242 A 7/1998 Kaufmann ..... 273/459
5,779,544 A 7/1998 Seelig et al.
5,779,549 A 7/1998 Walker et al. ..... 463/42
5,806,045 A 9/1998 Biorge et al.
5,816,918 A 10/1998 Kelly et al. ..... 463/16
5,820,460 A 10/1998 Fulton
5,823,874 A 10/1998 Adams ..... 463/17
5,833,536 A 11/1998 Davids et al.
5,851,148 A 12/1998 Brune et al.
D404,436 S 1/1999 McGahn et al. ..... D21/370
5,855,515 A 1/1999 Pease et al. ..... 463/27
5,876,284 A 3/1999 Acres et al.
5,902,184 A 5/1999 Bennett ..... 463/13
5,902,983 A 5/1999 Crevelt et al.
5,911,418 A 6/1999 Adams
5,919,088 A 7/1999 Weiss ..... 463/9
5,924,927 A * 7/1999 Matsuura et al. ..... 463/62
5,935,000 A 8/1999 Sanchez, III et al. ..... 463/17
5,941,772 A 8/1999 Paige ..... 463/20
5,947,820 A 9/1999 Morro et al.
5,951,397 A 9/1999 Dickinson
5,976,015 A 11/1999 Seelig et al. ..... 463/6
5,980,384 A 11/1999 Barrie ..... 463/16
5,993,316 A 11/1999 Coyle et al. ..... 463/25
5,997,400 A 12/1999 Seelig et al.
6,012,982 A 1/2000 Piechowiak et al.
6,012,983 A 1/2000 Walker et al. ..... 463/20
6,019,374 A 2/2000 Breeding ..... 273/292
6,039,648 A 3/2000 Guinn et al. ..... 463/16
6,077,162 A 6/2000 Weiss ..... 463/26
6,082,887 A 7/2000 Feuer et al. ..... 364/410.1
6,089,975 A 7/2000 Dunn ..... 463/16
6,089,976 A 7/2000 Schneider et al. ..... 463/16
6,102,400 A 8/2000 Scott et al.
6,110,043 A 8/2000 Olsen ..... 463/27
6,113,098 A 9/2000 Adams ..... 273/143
6,120,378 A 9/2000 Moody et al. ..... 463/20
6,128,550 A 10/2000 Heidel et al. ..... 700/232
6,135,885 A * 10/2000 Lermusiaux ..... 463/20
6,146,273 A 11/2000 Olsen
6,159,095 A 12/2000 Frohm et al. ..... 463/19
6,159,097 A 12/2000 Gura ..... 463/20
6,165,071 A 12/2000 Weiss ..... 463/24
6,165,072 A 12/2000 Davis et al. ..... 463/29
6,168,521 B1 1/2001 Luciano et al. ..... 463/18
6,186,893 B1 2/2001 Walker et al. ..... 463/20
6,190,255 B1 2/2001 Thomas et al. ..... 463/20
6,203,010 B1 3/2001 Jorasch et al. ..... 273/138.1
6,206,782 B1 3/2001 Walker et al. ..... 463/25
6,210,275 B1 4/2001 Olsen
6,210,277 B1 4/2001 Stefan ..... 463/27
6,224,482 B1 5/2001 Bennett ..... 463/20
6,224,484 B1 5/2001 Okuda et al. ..... 463/27
6,224,486 B1 5/2001 Walker et al. ..... 463/42
6,231,445 B1 5/2001 Acres ..... 463/42
6,238,287 B1 5/2001 Komori et al. ..... 463/20
6,287,202 B1 9/2001 Pascal et al. ..... 463/42
6,309,299 B1 10/2001 Weiss ..... 463/20
6,309,307 B1 * 10/2001 Krause et al. ..... 473/274
6,364,765 B1 4/2002 Walker et al. ..... 463/16
6,375,567 B1 * 4/2002 Acres ..... 463/25
6,508,709 B1 * 1/2003 Karmarkar ..... 463/42
2002/0039923 A1 4/2002 Cannon et al. ..... 463/42
2003/0060264 A1 3/2003 Chilton et al.

* cited by examiner

METHOD, APPARATUS, AND SYSTEM FOR PROVIDING A PLAYER WITH OPPORTUNITIES TO WIN A FEATURE EVENT AWARD

BACKGROUND OF THE INVENTION

1. Field of the Invention

The present invention relates generally to gaming devices and methods. More specifically, the present invention relates to gaming methods, devices and systems wherein a player may win opportunities to wager on a feature event such as, for example, on a live contest, a simulated live contest, or a reenacted live contest.

2. State of the Art

Electronic games and their methods and apparatus for use are well-known in the art. Electronic games include games of chance, games of skill, and games involving both skill and chance. Examples of patents describing various games of chance include U.S. Pat. No. 5,833,536 to Davids et al. (Nov. 10, 1998), U.S. Pat. No. 5,769,716 to Saffari et al. (Jun. 23, 1998), U.S. Pat. No. 5,820,460 to Fulton (Oct. 13, 1998) and U.S. Pat. No. 5,947,820 to Morro et al. (Sep. 7, 1999).

FIG. 1 is a block diagram of an exemplary electronic gaming device 100 as found in the art. An electronic gaming device 100 typically includes a microprocessor or other computer 104 having a central processing unit (CPU) 106 and memory 108. The computer 104 may be coupled to a number of peripheral devices such as, by example only, a display screen 110 (e.g., a cathode ray tube (CRT), plasma display, liquid crystal display (LCD), and/or a display based on light emitting diodes (LED)), possibly having a touch-screen input 112 (see U.S. Pat. No. 5,951,397 to Dickinson (Sep. 14, 1999)) for display of graphics associated with one or more games playable on gaming device 100. Buttons, keys or other user input devices 114 are also operably coupled to CPU 106 for initiating game play and for other functions associated with play of a game. Preferably a coin, currency or card acceptor device 116 (to accept a credit card, gaming card, smart card and the like) permits a player to enable play of a game by placing one or more wagers. The electronic game may also include a separate scoreboard display 118 to indicate a player's success, or display the player's accumulated winnings. A coin and/or currency dispenser 116*a* may also be included, or a player's winnings credited back to him or her using the card acceptor device 116.

Electronic games may also be coupled to one or more other computers such as a central controller 120 of a casino, e.g., via a network card 122 and link 124, modem 126 and the like. The game parameters 128, such as how, when and where particular images will appear on the display screen 110, how the game works and how to operate the various elements operably coupled to the computer 104, are stored in the memory 108. Often, the electronic gaming device 100 may be housed in a structural and/or decorative housing 102 (shown in broken lines) as is well-known and understood by those of ordinary skill in the art.

As noted above, initiating an electronic game can be done as simply as by inserting a coin, token, or other type of currency. Another more comprehensive example of initiating a game includes inserting an identification card, such as a "smart card" having a programmed microchip or a magnetic strip coded with a player's identification, credit totals and other relevant information. See U.S. Pat. No. 5,265,874 to Dickinson et al. (Nov. 30, 1993), the disclosure of which is hereby incorporated by reference herein. It is also known to use a writeable identification card, such as a smart card to eliminate the need for a network or direct connection between remote systems and a common controller or point database such as is described in U.S. Pat. No. 5,806,045 to Biorge et al. (Sep. 8, 1998). Promotional point and credit information may be retrieved, recorded and updated using the smart card. Additionally, it is known to transfer money to a game through an electronic funds transfer as described in U.S. Pat. No. 5,902,983 to Crevelt et al. (May 11, 1999).

In addition to the manner described above, it is also possible to participate in a game of chance via the Internet. This is typically accomplished through a casino or game host site offering displays similar to those found in conventional electronic games. Generally, to play a game of chance via the Internet, a software file is downloaded to a player's computer or terminal, which may then be used to install the necessary software for the game and/or access the casino or game host Internet site. As with a conventional electronic game, Internet electronic games may be accessed using an identification code or name to identify a specific player and retrieve that player's credit total or play history.

Existing electronic game displays typically include multiple images representing various aspects of a game such as a game portion, a credit total portion and a wager amount portion. Other electronic game displays include an additional bonus award portion to indicate an amount of a bonus award which may be won, typically through multiple or secondary games. See U.S. Pat. Nos. 5,851,148 to Brune et al. (Dec. 22, 1998) and 5,911,418 to Adams (Jun. 15, 1999).

Bonus gaming, also known in the art, includes employing a secondary game, often a different type of game than that of the primary game, as an additional activity for a player of the primary game. Implementation of a bonus game includes providing a game of chance, such as, for example, one like that described above with reference to FIG. 1, as a first or a primary gaming unit. Another gaming unit is then provided as a secondary, bonus game which is typically accessible upon receipt of a winning hand (in the case of a card game) or the occurrence of a specified symbol, icon, or indicia or one or more specific combinations of same during play of the primary gaming unit. Often the existence of a bonus game serves to attract a player though the perception of having increased opportunity to win during the player's gaming activities .

Such bonus gaming may also be conducted through a plurality of networked games such that the secondary gaming activity might involve a plurality of individuals who have been wagering at primary gaming units. Some examples of bonus gaming include U.S. Pat. No. 5,779,544 (Jul. 14, 1998), U.S. Pat. No. 5,664,998 (Sep. 9, 1997) and U.S. Pat. No. 5,560,603 (Oct. 1, 1996) all to Seelig et al. More particularly, some examples of bonus gaming including a plurality of networked primary gaming machines include U.S. Pat. No. 6,146,273 to Olsen (Nov. 14, 2000), U.S. Pat. No. 6,012,982 to Piechowiak et al. (Jan. 11, 2000), and U.S. Pat. No. 5,876,284 to Acres et al. (Mar. 2, 1999).

The Seelig et al. patents describe variations on a bonus game wherein the bonus game may include one or more contestants in a race. In one embodiment, each player wagering at a primary gaming unit may be represented by a particular contestant in the race. The contestant representing a particular player advances in the race according to the represented player's gaming activity at the primary gaming unit. Thus, for example, once a player is participating in the bonus game configured as a race, a continued series of winning outcomes in the primary gaming unit is required for each race contestant to advance during the race. A specified winning outcome in the primary gaming unit is said to move the contestant ahead a predetermined distance while the race is in effect. The race ends upon a contestant finishing or upon the expiration of a predetermined amount of time, whichever comes first.

As noted above, bonus games serve to entice the player to wager at a particular primary game with the hope of being rewarded through the potential of increased winnings. However, with games such those described in the Seelig et al. patents, the player may lose interest sooner than would be desired by the gaming property owner or operator since the odds of winning the bonus game are directly tied to the odds of repeatedly winning the primary game. Thus, a player might eventually feel that there is no real potential of increased winnings since the odds of winning the above described bonus games are dependent on the play of the primary gaming unit and thus do not change with regard to a player's participation in the secondary or bonus game.

While the use of bonus games has been beneficial in the initial attraction of players to a primary gaming machine and the placement of a wager for play of the primary game, there are numerous areas wherein improvement may be made. For example, considerable expense is associated in either providing new machines, or in retrofitting or modifying existing machines to include a secondary game. Additionally, as noted above, the use of bonus gaming may not always convey the intended feeling to the player that there is a real possibility of enhancing winnings through participation in the bonus game. Also, many secondary gaming systems fail to entice new players to place a wager with the primary gaming unit, such as those players typically drawn to a different type of wagering activity.

In view of the shortcomings in the art, it would be advantageous to provide a gaming device and method which allows for a secondary wagering opportunity wherein the player perceives potential of additional winnings which are separate and independent of the primary gaming activity. Additionally, it would be advantageous to provide a gaming device and method including a secondary wagering activity to entice new players to place a wager with the primary gaming unit.

It would also be advantageous to provide a gaming device or system which allows for a combination of resources in the production of a secondary wagering activity, such that expense of implementation and operation might be reduced or minimized. Particularly, it would be advantageous to provide such a gaming system which allows for the use of existing facilities and resources within a casino or other gaming site.

It would additionally be advantageous to provide a gaming system and method which allows players remotely located from a casino or host site to participate in both a primary game and a secondary wagering activity. In so doing, it would be advantageous to provide such remote gaming opportunities to individuals via the Internet, as well as to individuals located in remotely located casinos or gaming facilities.

BRIEF SUMMARY OF THE INVENTION

In accordance with one aspect of the invention, a method of qualifying for, and conducting, a game of chance is provided. The inventive method includes providing a player with an opportunity to place a wager for play of a primary game on a first gaming unit. A random outcome, such as, for example, a random combination of indicia shown on a plurality of reels or simulated reels, is produced by the first gaming unit. Alternatively, the random outcome may be represented in the form of randomly dealt cards such as in an electronic video poker machine. Similarly, other electronic or electromechanical primary games of chance are suitable for producing one of a plurality of random outcomes wherein certain predetermined random outcomes serve as winning outcomes. Based upon a predetermined aspect of play or wagering with the first gaming unit to one or more predetermined outcomes of the plurality of random outcomes, the player is then qualified for an opportunity to participate in a feature event. Stated another way, the player of the primary game may, in addition to or in lieu of a monetary payout, win a wager on a feature event.

The feature event may comprise at least one of a live contest, a reenacted live contest, or a future feature contest for which one or more players may be qualified through play on primary gaming units. Details of such contests shall be defined and described in greater detail below. However, as an example, a live contest may include a live horse race, broadcast or displayed for the player to watch and wager upon. Similarly, an example of a reenacted live contest may include the broadcast or display of a horse race, randomly selected from a plurality of previously run horse races. A future feature contest, for example, might include a simulated horse race wherein the winner is randomly selected and the odds provided are similar to those of an actual horse race.

Qualification for what in some embodiments may be characterized as a "prepaid" opportunity to wager in the feature event may be dependent upon the occurrence of a predetermined activity associated with the first gaming unit. Thus, for example, qualification may depend on the display of a predetermined outcome in the first gaming unit or of a particular symbol, icon or indicia or combination of same appearing as a part of the random outcome produced by the first gaming unit. Alternatively, qualification may depend in part on whether or not the player has placed a wager of a predetermined value or has wagered a predetermined cumulative value within a predetermined period of time.

A plurality of primary gaming units may be networked together such that multiple players may participate in the same feature event. The networking of such primary gaming units may additionally include gaming machines from multiple casinos at different locations. Similarly, it is contemplated that a primary gaming unit may be in the form of a personal computer and that the player may be able to qualify for the feature event over the Internet and participate in the feature event by transmission of the feature event via the Internet. Such networking may allow the gaming operator to expand the number of potential participants and possibly reduce overhead in the implementation and administration of the feature event.

The timing of the feature event may be set up as is determined to be most desirable by the operator. However, as examples of such feature event timing, the feature event may be activated at predetermined time intervals or when a predetermined number of players have placed wagers with or have otherwise qualified through the participating first gaming units. Alternatively, the feature event may be activated randomly, dependent upon one or more of the participating first gaming units having a predetermined outcome. Of course, if a live contest is being exhibited as the feature event, it is expected that such a contest will take place at a specified, predetermined time. However, greater flexibility in the timing of the event may exist with respect reenacted live contests and future feature contests.

The act of wagering on the feature event may also be conducted in various ways. For example, if the feature event includes a race of any kind, it is contemplated that pari-mutuel wagering may be implemented. Additionally, a player may be allowed to qualify more than once prior to the feature event, and with each qualification he/she may enhance the wagering opportunity. This enhancement may be as simple as providing a larger wager for placement by the player on the feature event or, for example, in contemplating a horse race as the event, if an individual qualifies twice they may be allowed to "bet" on a second horse, or to place an "exacta" wager wherein they pick the winner and second place horse in proper order. Similarly, if a player qualifies three times prior to the event, they may be allowed to pick three potential winners, or to place a "trifecta" wager wherein they pick the first three horses to finish and the order of the finish. Thus, once a player is qualified for the event, there is motivation for continued wagering on the primary gaming unit. Additionally, or alternatively, once a player has qualified one or more times, they may be allowed to defer their opportunity to wager until a later event. In other words, in some embodiments a qualified player need not wager on the first feature event subsequent in time to their qualification.

In accordance with another aspect of the present invention, another method of conducting a game of chance is provided. The method includes placing a wager with a primary gaming unit which is configured to generate a series of random outcomes, such as a slot machine, a video poker machine, or any other suitable electronic or electromechanical type gaming machine. The method further includes qualifying for a wager on a feature event based upon the occurrence of a predetermined activity associated with the play of the primary gaming unit. The feature event, for which qualification to wager upon is necessary, includes at least one of a live contest, a reenacted live contest, or a future feature event as shall be described herein.

The method may include various other aspects similar to those described herein. Such additional aspects may include, without limitation, placing the wager with the first gaming unit via a personal computer and transmitting the event via the Internet. Other such additional aspects may include the predetermined activity which serves as qualification, the timing of the event, and the manner in which a wager may be conducted with regard to the event.

In accordance with yet another aspect of the invention, a gaming system is provided. The gaming system includes at least one primary gaming unit, also referred to as a first gaming unit. The first gaming unit is configured to generate a series of random outcomes and thus may include any of a number of suitable electronic or electromechanical gaming machines. At least one secondary, or second gaming unit is operatively coupled to the at least one first gaming unit such that the ability to "play" the secondary gaming unit is dependent upon the happening of a predetermined activity within the first gaming unit. The secondary gaming unit includes a display screen which is configured to exhibit an event comprising at least one of a live contest, a reenacted live contest, and future feature contest.

The system may further include a plurality of first gaming units networked and operatively coupled to a secondary unit or a plurality of secondary units. The first gaming units may all be of the same kind of gaming unit (i.e., all jackpot type machines) or they may include multiple types of machines networked together, each machine having similar odds of winning a wager. The plurality of first gaming units may all be tied to a common (or multiple common) secondary gaming unit(s). Alternatively, each of the plurality of first gaming units may have an associated secondary gaming unit combined within the same housing. In any case, all of the machines may be networked such that they all participate in the same feature event through a simultaneous exhibition of the event through the displays of the secondary gaming units. Alternatively, each primary gaming unit may have a dedicated secondary gaming unit or a secondary gaming unit independently linked to a controller administering the feature event such that the timing of the exhibition of the feature event is independent from one gaming machine to another to facilitate running of the feature event on a stand-alone basis.

The plurality of networked gaming units may include offsite gaming units such as those located at another casino. In such a case, it is possible to arrange the feature events such that each participating casino is represented in the feature event and that a player's ability to win his/her wager on the feature event is dependent upon the performance of the participant in the feature event which represents the casino at which the player is currently gambling. Such a system would allow a competitive feeling to be engendered amongst the participating casinos (and their patrons) while allowing the casinos to share in the revenue and overhead associated with producing the feature event.

Additionally, the plurality of networked gaming units may include personal computers wherein the primary game is played on the personal computer via downloaded software as is known in the art. A qualified individual may then be allowed to wager on the event and witness the event on the same personal computer via a transmission of the event over the Internet, such as through streaming audio or video as is known and understood by those of ordinary skill in the art.

The system may include further variations, such as variations on the qualifying activity or the timing of event exhibition as discussed with respect to other aspects and embodiments of the invention.

In accordance with yet another aspect of the invention, a gaming device is provided. The gaming device includes a first gaming unit having random number generator for selecting a random combination of indicia. Thus the first gaming unit may be any of a number of electronic or electromechanical gaming machines utilizing a random number generator to produce an outcome. An event display is electronically coupled with the first gaming unit. The event display is configured to exhibit a feature event comprising at least one of a live contest, a reenacted live contest, or a future feature contest. The first gaming unit is configured for entry into the feature event upon a predetermined activity associated with the first gaming unit.

The random number generator may be in the form of a central processing unit (CPU) such as a microprocessor, and indeed the first gaming unit may be in the form of a personal computer. In the case that the first gaming unit is a personal computer, the event display may include the monitor of the personal computer such that the event is transmitted via the Internet and exhibited on the monitor.

A gaming unit may be configured to be networked with additional gaming units. Similarly the event display may be configured to be coupled with multiple gaming units. Thus, it is contemplated that the display and the gaming unit need not be housed as a single unit, but rather may be remotely located from one another. Indeed the display may be an existing display such as the monitor or large screen television utilized in the sportsbook area of a casino or gaming facility. Utilization of such existing equipment and resources allows for less expense in the implementation of such a gaming device, as well as more efficient use of the existing resources.

As used herein, the term "game of chance" includes and encompasses not only games having a random or arbitrary outcome, but also such games which also invite or require some player input to the game having at least a potential for affecting a game outcome. Such player input is generally termed "skill" whether or not such input is in actuality beneficial in terms of game outcome.

BRIEF DESCRIPTION OF THE SEVERAL VIEWS OF THE DRAWINGS

The foregoing and other advantages of the invention will become apparent upon reading the following detailed description and upon reference to the drawings in which.

DETAILED DESCRIPTION OF THE INVENTION

Figure 1:
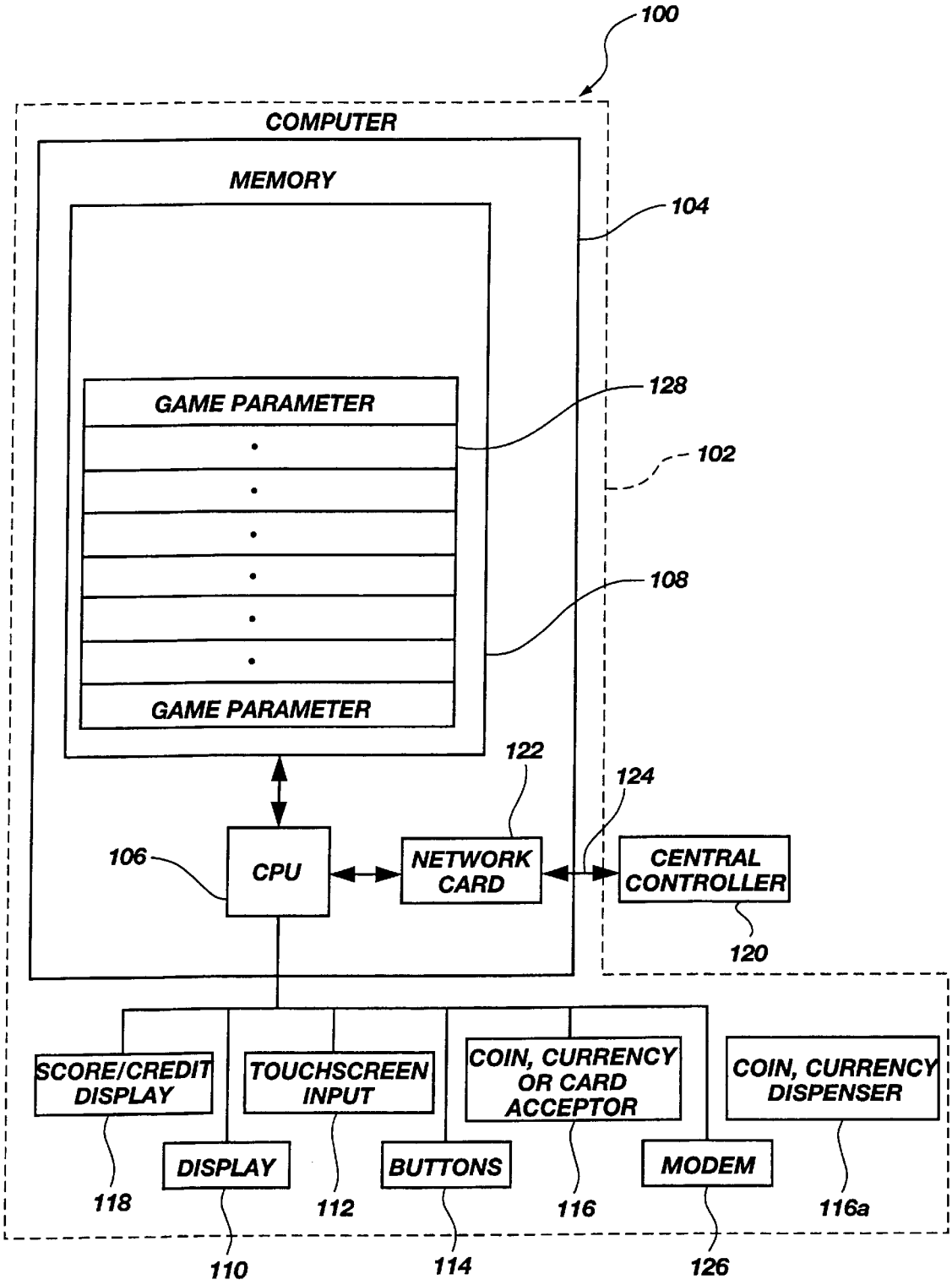
Fig. 1 (PRIOR ART)
FIG. 1 is a schematic of a conventional, prior art electronic gaming machine.
Figure 2:
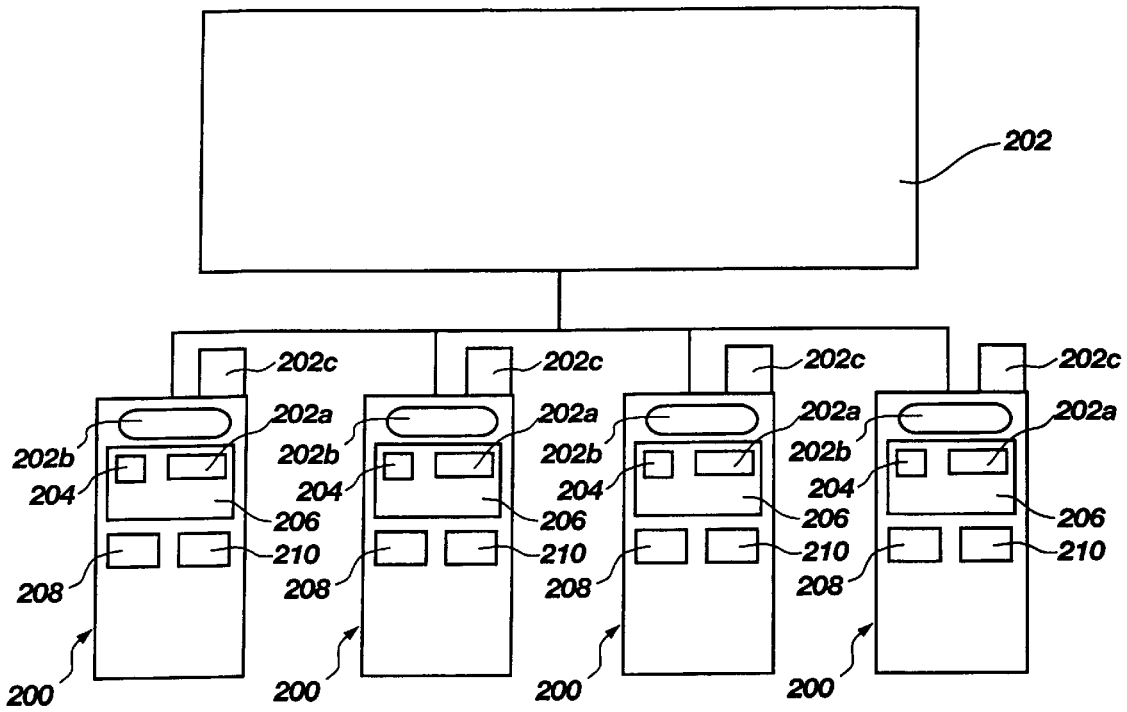
FIG. 2 is a diagram of a plurality of gaming machines arranged in a bank and having an event display associated therewith according to the invention.

Referring to FIG. 2, one embodiment of the present invention is shown and described wherein a bank of gaming machines 200 (shown as four by way of example only and not limitation), which may also be referred to as primary or first gaming units, are in communication with a feature event display 202. The feature event display 202 is preferably positioned so as to be viewable by players of each gaming machine 200 connected thereto. The display may be an existing display in a casino, such as the display utilized in a sportsbook venue of the casino and which may either experience periods of nonutilization, or which may be displaying a particular event on which wagers are otherwise being placed directly and such event is desired to serve as the basis for the feature event as shall be described below herein. Gaming machines 200 may include some or all of the features of conventional gaming machines 200 as described above with respect to FIG. 1, modified and augmented as set forth herein.

The base, or primary, game on each of gaming machines 200 may be, for example, a multiline, five reel spinning reel game, either electromechanical with actual moving reels or electronic with simulated reels and movement thereof, the game awarding prizes when specified numbers, types and configurations of symbols (also termed elements, icons or indicia), occur on a winning pay line or otherwise visibly displayed in a winning pattern. Alternatively, the primary game or first gaming unit may comprise any other reel-type game, card game, or other game of chance susceptible to representation in an electronic or electromechanical form which produces a random outcome upon activation through a wager therewith.

In any case, a special symbol or element on one or more of the reels (or otherwise displayable if other than a reel-type game), sometimes referred to herein for convenience as an "event symbol," may be associated with qualification for entry in a future event. Once a player has been qualified for participation in the feature event, the player may subsequently enhance his/her feature event participation opportunity through continued play on the primary gaming unit. Thus, for each event symbol that appears on a winning pay line or other predetermined display location, a given number of feature event wagering points or credits may be accumulated in a "pool meter" programmed to accrue the feature event wagering credits toward eventual entry in a future feature event. The occurrence of multiple such event symbols or a pattern thereof on the primary game display may result in an arithmetic or geometric increase in the number of feature event wagering credits awarded, or such occurrence of multiple event symbols alone or in combination with a predetermined pattern thereof may be made a condition precedent to feature event entry.

It will be understood that the concept of winning a "wager" to enter a feature event may be implemented in various manners. For example, a player may win a unit "entry" into the feature event, the entry qualifying the player to win an award resulting from the outcome of the feature event. One or more unit "entries" may be won, and each entry placed by the player or at random on the same or a different horse or other contestant in the feature event. Alternatively, feature event wagering points may be accumulated by the player by play of the primary gaming unit, such feature event wagering points having no intrinsic value other than in the context of wagering on the feature event, wherein the player may allocate or "bet" the same or varying numbers of feature event wagering points on different contestants. The previously mentioned exacta and trifecta betting arrangements may also be implemented using either the unit entry or feature event wagering point approach.

Alternative means of qualifying for the feature event may also be employed. Such alternatives may include, for example, the placement of a predetermined wager placed with the primary gaming unit. For example, while a minimum wager with the primary unit may be 25 cents, qualification for feature event participation may require a wager of 50 cents with the primary gaming unit. Similarly, the maximum allowed wager (for example, three times or five times a minimum bet) with the primary gaming unit may be required to qualify a player for a wagering opportunity on the feature event. Additional means of qualifying a player for the wagering event may include, without limitation, the display of the event symbol a predetermined number of times within a predetermined time period or within a predetermined number of wagers placed with primary gaming unit, alone or in combination with a occurrence of a predetermined number, pattern or both of the event symbol on the display of a given primary game outcome. Alternatively, a player's rate of primary game wagering may be monitored such that a sustained rate of such wagering over a predetermined period of time may qualify the player for participation in the feature event. Thus, entry into a feature event may be restricted to those players playing and winning primary games on a select group of gaming machines and not merely inserting a given number of credits into the machines to be diverted to the feature event.

When the time for exhibition of the feature event has arrived, any players currently qualified for feature event participation may be queried through a dialog box 204 on each display screen 206 or otherwise readily visible to the player on the face of each gaming machine 200 as to whether they wish to participate in the next feature event. Alternatively, the players may be automatically entered in the next feature event and advised of such entry through the dialog box 204 and, optionally, an audio signal (trumpet blast, bells, music, etc.). In any case, when it is determined that the player will make a wager in the next upcoming feature event, the event credits or unit entries required for entry to the feature event, or the number of credits or feature event wagering points to be wagered as the case may be, may be deducted from the accrued pool of points or credits at the gaming machine 200. Alternatively, no feature event or monetary credits may be deducted and each triggering activity associated with the primary game may be characterized as a single entry to or wager on the feature event. If desired, a countdown clock may be provided on display screen 206 to prompt the player to a state of readiness for exhibition of the event during the last, for example, two minutes prior to exhibition of the event. If desired, a qualified player may be allowed to defer his/her opportunity to wager until a later feature event, thus allowing the player to accrue more event credits, unit entries or feature event wagering points and thus enhance the wagering opportunity.

One or more of a plurality of criteria may be selected to initiate exhibition of the feature event, including initiation at regular intervals (i.e., trigger an event one half hour after conclusion of the last), according to a specific schedule (every hour on the half hour), according to the number of qualified players (when fifty players have qualified for wagering in the feature event), or randomly throughout the day. On a stand-alone gaming machine, feature event exhibition may be automatically initiated when qualification criteria has been met.

As noted above, a player may be automatically entered in the feature event when qualified, or may be permitted to accrue additional event wagering credits, points or additional entries, for example, to place multiple wagers in a single, subsequent feature event, or to place individual wagers in a series of subsequent feature events.

The feature event for which players become qualified to wager upon may be any of a number of contests or contest types. One example of a wagering event includes a live contest. While such contests may include any number of live events, such as sporting events, it is contemplated that the event be relatively short in duration. Thus, a contest, such as a horse race, a dog race, a track and field event, a ski race, or a race involving vehicles with a short track length or duration (i.e., drag race or sprint race) would all be appropriate. In exhibiting a live event, such as a horse race, the qualified players would, in all probability, be allowed to place a bet on the contestant or participant they believe would prevail in the contest. It is noted that, as used herein, the terms "contestant" and "participant" each refer to an entity competing in some manner in the feature event contest and is the entity upon which a wager may be placed. A nonlimiting example of such would include the horse and/or jockey being a contestant in a horse race. On the other hand, the term "player" refers to an individual who interacts with a gaming machine of some type, qualifies by winning or buying a wager or entry in an upcoming feature event, and places the wager on a contestant or participant.

In the example of utilizing a race type contest for the feature event, a player might, in addition to or in lieu of placing a wager for the event winner, be allowed to place a wager of "place" indicating either a first or second place finish, or a wager of "show" indicating either a first, second or third place finish. Of course, a payoff for a "place" or "show" wager would be reduced from that of an outright win as is understood by those of ordinary skill in the art. Similarly, a qualified player who has enhanced his/her feature event wagering opportunity through continued play of the primary game and the subsequent accrual of event credits, may be allowed to place wagers of"exacta" or "trifecta" allowing the qualified player to wager respectively on the order of finish of the first two or three participants to finish the contest.

As noted above, other longer duration contests may be suitable for utilization as the feature event for which qualification for the right to wager is sought. For example, boxing, basketball, baseball, football, hockey, or nearly any other sporting event may be utilized. Taken to another level, the live contest could even be characterized to relate to a specific participant's or team's performance during a specific game (i.e., the amount of points a particular player or team will score). However, if such games, matches or performances are chosen as the feature event, it is contemplated that each qualified player may receive some type of token or ticket as evidence of his or her qualification and the amount, number and type of "wager" placed, or that the status of such qualification be noted on a "smart card" which may then be redeemed for the opportunity to wager on the feature event at the proper venue and at the proper time within the casino, or to collect winnings from the outcome of the feature event after it is conducted. In the latter instance, the wager may be automatically placed in a gaming system as described below and processed when the feature event takes place, the player then being able to subsequently and even remotely being able to access the outcome using his or her smart card or a player tracking card in combination with a personal identification (PIN) number or other identifying indicia assigned to the player/wager combination for that feature event.

Another contest which may be utilized as the feature event is that of a reenacted live event. Such a contest particularly lends itself to activities such as racing, including horse or dog racing or track and field events. In the case of utilizing reenacted live contests, a series of recorded contests may be collected and compiled. Thus, for example, several hundred horse races, which were actually run and recorded during such live events, may be compiled. At the time for exhibition of the feature event, one of the several recorded races may then be selected at random and shown on the display or a random outcome generated and a race consistent with the randomly generated outcome displayed. The wagering methods or techniques allowed on the reenacted live feature event would thus be the same as those used in the live event. Thus, if wagers of"place," "show," "exacta," "trifecta" and the like are allowed in a similar live contest, they may likewise be allowed in the reenacted live contest.

It is noted that the compilation of numerous recorded contests would still allow for randomness in the outcome of the feature event thus maintaining a desired statistical set of odds and pay table as determined by the owners and operators of the gaming devices, as the appropriate recorded contest may be automatically selected. Also, while players would likely be kept from memorizing specific outcomes of the recorded events by the multiplicity of events compiled in a given collection, additional steps might be taken to decrease such action by a player. For example, such recorded events could include audio dubbing or other audio/video manipulation to render the event contestants generic. Thus, in a horse race, for example, rather than disclosing the names of the horses and/or jockeys, they could be identified by simply by their numbers. In many instances, using the real identities of the horses involved but not the time or place of the race will sufficiently obscure any ability to bet using historical data.

Another type of contest which may be used for the wagering event is that which shall be termed a "future feature contest." A future feature contest, as used herein, is defined as a simulated contest with at least two participants or contestants wherein the outcome of the contest is random and also independent of any outcome produced by any of the participating primary gaming units. Another possible element of the future feature contest may be that, as in the case of live or recorded feature events, there is the potential for all qualified players to win or for all qualified players to lose since all qualified players may potentially wager on the same participant or contestant. A future feature contest may include simulations of actual contests, such as the simulation of a live race or other sporting contest. Such simulations, given the current and emerging technology regarding animation graphics, may even appear to be a live or reenacted live contest. The odds of winning a wager placed in such a contest may be tightly controlled with each contest being randomly determined by, for example, a random number generator. Use of a simulated feature event permits a wide range of possible themes, such as a race between characters themed to a particular game (parrot, whale, bee, etc.), or to a "mascot" or other identifying character associated with a particular casino (MGM Lion, Mirage white tigers, Venetian gondolas, etc.). Casino themes may be particularly effective in a linked, inter-casino feature event where a player must be physically present in a particular casino to wager on its particular contestant representing it in the feature event. A lottery-like drawing or casino style game may also be used, if desired, as a feature event.

The manner of wagering on the feature event once qualified may, as noted previously, also be varied, depending on the wagering parameters set by the event administrator. For example, each player winning an entry or wager may be permitted to place same on any desired participant or contestant. Multiple won entries or wagers might be placed on the same participant or contestant, or distributed among multiple participants or contestants. Combination wagers, such as the place, show, exacta and trifecta wagers previously mentioned, may or may not be permitted. The game outcome of the primary game, e.g., what symbol pattern is hit, may be used to determine the wager. Each gaming machine in a bank or other network of gaming machines may be assigned a contestant in the feature event and which is wagered on in the event of qualification on that machine. As noted previously, the player may choose the contestant, or the contestants may be assigned to each gaming machine randomly or in the order of qualification for the feature event, so that the first machine qualified is assigned (in the context of a car race feature event) the car with the "pole" position.

The gaming machines 200 of the bank of machines may be programmed to exhibit individual feature events, each such event being similar to the other events in contest type, requirements for qualification, and exhibition of the event. Alternatively the machines 200 may be programmed to enter one of several different event modes as dictated by the casino or event sponsor. For example, one or two live contests might be displayed at specific times during a given day while reenacted live contests or future feature contests may be exhibited throughout the day and activated according to alternate scheduling criteria. Another variation might include a grand event mode. A grand event mode might be implemented on a daily or other periodic basis wherein players who are identified as winners of a prior feature event are the only qualified individuals to participate. Thus, feature events may be run in "brackets" and a large group of players previously winning feature events narrowed down in one or several contests to two finalists competing for a grand prize. Another alternative is to periodically, or when desired, allow gaming machines in other banks the opportunity to qualify for wagering on the feature event thereby increasing the number of potentially qualifying individuals for the upcoming feature event. Such additional gaming machines may include, for example, other gaming machines on the casino premises or gaming machines in other casinos (which may be affiliated casinos or casinos otherwise agreeing to participate in such an arrangement). Such gaming machines may be located in a single city or, alternatively, statewide such as in a wide area progressive format. A series of exhibited feature events may be conducted so as to stimulate player interest in frequent qualification for event wagering. Of course, the grand event mode may be employed in conjunction with the concept of extending the number of participating machines so that, for example, feature event winners throughout a specified city or state on a given day are entered in a grand event at a specified time each day.

Further, the concept of extending the opportunity to qualify for the feature event to additional and remote machines is not limited to banks, or groups of machines, located at casino properties. Such networking may also include the use of personal computers as a primary gaming machine. As is known in the art, such personal computers may download software for play of the primary game. Upon qualification, which is contemplated to occur in a manner similar to qualification on a primary game located on a casino property, the player may be presented with an opportunity to wager on a specified feature event. It is contemplated that the software downloaded to the computer terminal may include a schedule of feature events in which the player may participate. Alternatively, a schedule of feature events may be posted on an Internet site associated with the casino or sponsor of the feature event. According to the determined feature event schedule, the player may then witness the event through his/her own personal computer terminal via the Internet, such as through streaming audio or video.

During feature event wagering, the player's event credits may be displayed on an event credit meter 208 at his or her gaming machine 200. At the end of a given event, the winner or winners are determined and their winnings posted to the event credit meter 208 at each winner's gaming machine 200. Subsequent to the exhibition of a feature event, the total displayed by the event credit meter 208 may be accessed by the player through means of a prompt such as a touch pad for cashing out the credits received through wagering on the feature event. If desired, after the feature event, any accumulated event credits may be converted or transferred to the credit meter of the primary gaming unit 210. Alternatively, a single credit meter operating in both primary game mode and feature event mode may be employed. Similarly, if allowed by the gaming administrator, a player may be able to transfer credits from the primary gaming credit meter 210 to the feature event credit meter 208 for increased wager amounts. Such an approach may be employed to permit a player who has qualified for the feature event to place an additional monetary wager if desired. In the event the total pay out to a player exceeds a predetermined amount allowed to be paid by a gaming machine 200, the award may be paid by an attendant.

The awards provided for a winning "wager" in the event may be structured in numerous ways. For example, awards may be structured as a plurality of fixed prizes corresponding to a unit entry. Thus, for example, if the event included a race or similar contest, a fixed prize may be awarded for a "win" wager, with fixed prizes of lesser values being awarded for successful "place" and "show" wagers. If feature event wagering points are employed, then the awards would be in proportion to the points wagered. There may also be a token prize awarded to every entrant so that every entrant wins something.

Optionally, and as referenced previously, pari-mutuel type wagering may be implemented such that the awards will vary depending on how many wagers are made and on which contestant. Another alternative for structuring the awards might include implementation of a progressive jackpot. Such a progressive jackpot would retain the awards not disbursed in previous feature events and add them to the funding of another feature event exhibited subsequently in time.

As yet another variation, a winner-take-all pool, which may be funded by a percentage of the feature event credits or points wagered may be provided. If so, the player or players placing a successful wager in the event will be awarded the winner-take-all pool. In the event of multiple winners, the award may be structured such that it is split between the multiple winners, or a tie breaker may be performed through conduct of an additional feature event. Other means of breaking such a tie may be utilized including assessing criteria associated with the players' wagering on the primary gaming units such as which player was first in time to qualify for the feature event. If the feature event is structured as a race event, the order of finish of players' entries may be used to provide awards of varying magnitude or, alternatively, the order or placing of each entrant which has not completed the race at the time the first finisher crosses the finish line may be used to determine awards for those other players. If the feature event is an elimination competition, such that only one entrant or contestant remains at the end of the event, the winner may be the last competitor. If a number of gaming machines contribute to the win of a winning competitor, the associated award may be split in proportion to each gaming machine's contribution. Another variation of an award scheme would be to establish an award pool from which all participating players would receive an award with, for example, the player triggering the feature event receiving the largest share and other players participating in the feature event receiving lesser awards related, again by way of example only, to at least one of their win, lose or play rate.

The event display 202 may be used for various purposes before and during event exhibition. For example, the available awards and the number of qualified players may be displayed between and during exhibition of the event. The event display 202 may be an existing display used for other purposes within the casino. For example, the event display 202 may be a large screen television or monitor used in the sportsbook venue typically utilized in viewing various contests or games. Use of such an existing screen during periods when the alternative wagering venue (such as the sportsbook venue) is typically idle promotes greater efficiency of existing resources and may serve to reduce overhead costs and/or capital expenditures.

Depending upon the locations of gaming machines configured for event qualification according to the present invention, an event display 202 may comprise one or more separate devices apart from the gaming machines 200 or, optionally, may be incorporated into each machine in addition to or in lieu of a separate, discrete event display. For example, the event display may comprise a segment 202*a* of a main game display screen 206 or comprise a separate display 202*b* either built into the chassis of the gaming machine 200 or an add-on display 202*c*. Display of promotional information for the feature event may optionally be displayed while the event is not taking place. Such promotional information may include the time or times of subsequent feature events. Similarly, accrued jackpot values, fixed award values, and/or previous event winners may be displayed between or during events as desired by the casino or sponsor.

One specific implementation of the present invention is in the context of a bank of gaming machines connected to a feature event device such as an event controller, as described more particularly below with reference to FIG. 3, and to one or more large displays visible from each machine as previously described with respect to FIG. 2. The feature event device is programmed to depict a car race having eight cars entered. The race runs every ten minutes and runs for approximately twenty seconds. Each car has equal odds of winning. Awards are made based upon which cars finish first, second and third. Prize pools are established for win, place (first or second), show (first, second or third), exacta (first and second, in order) and trifecta (first three places in order). If a prize pool is not won, it carries over to the next race. The gaming machines each have a five reel, multiline spinning reel game in the form of an electronic game with video display. One symbol is a car. If a player is wagering all paylines in the reel game and gets five cars anywhere on the display, he wins an entry into the feature event. A first entry earned allows the player to select a car to win. If a second entry is earned, that entry allows the player to select a car to place, which also qualifies him for the exacta. If he earns a third entry, that entry allowed him to select a car to show, which also qualifies him for the trifecta. If additional entries are earned before the feature event, another wager sequence as described immediately above is commenced.

Figure 3:
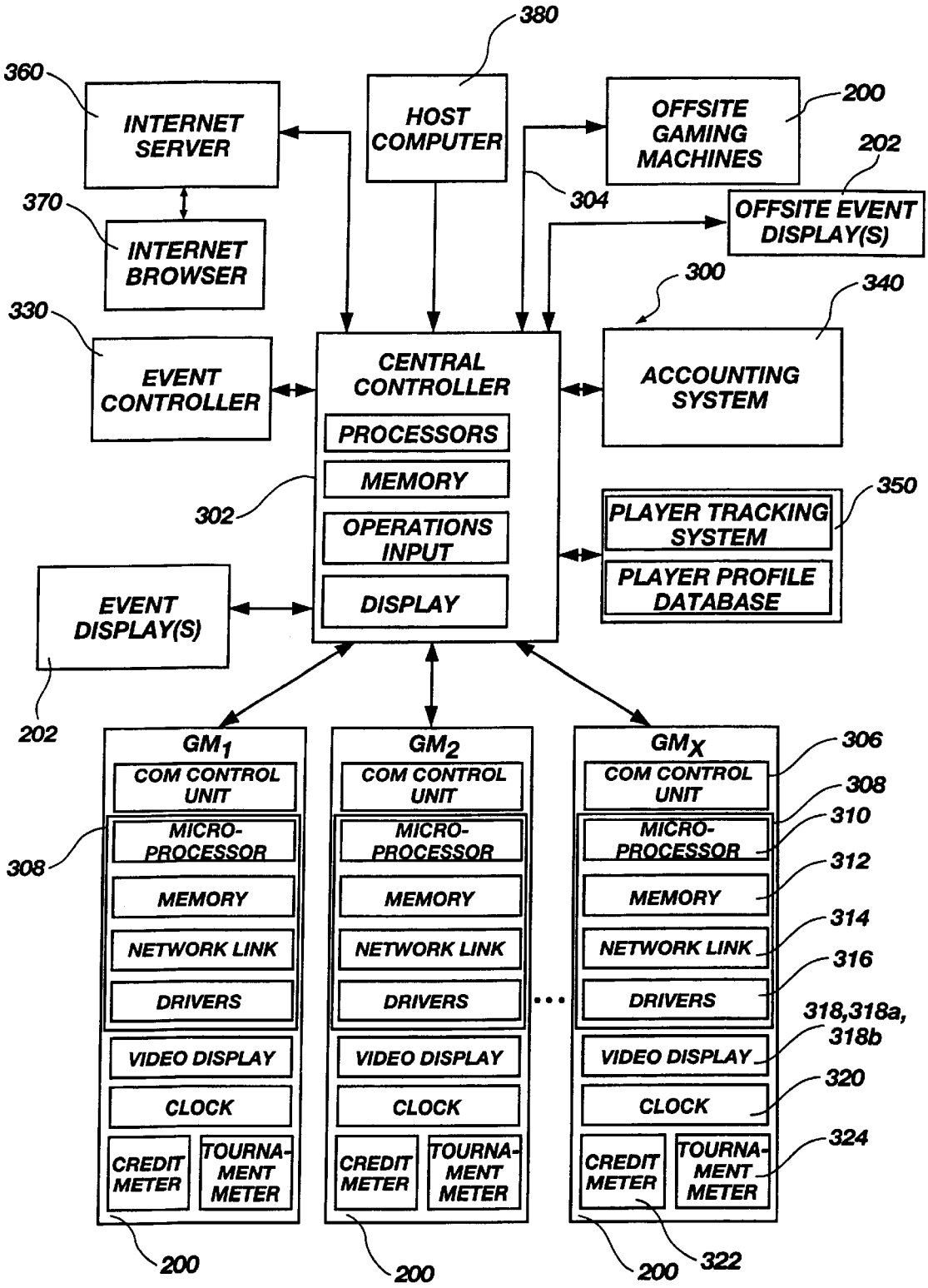
FIG. 3 is a schematic diagram of a configuration in which the plurality of gaming machines and event display of FIG. 2 may be incorporated in a host computer-controlled event type gaming system according to the present invention.

With regard to the concept of linking or networking multiple gaming machines, FIG. 3 comprises a schematic illustrating multiple gaming machines 200 linked to a host computer in a manner suitable for implementing a feature event according to the present invention. Event wagering system 300 includes a central controller 302 operably coupled to a plurality of gaming machines 200 designated as $GM_1$ through $GM_x$. Gaming machines 200 may comprise a single type of machine (e.g., reel-type or card game type), multiple types of machines, or may include multigame machines as known in the art. Central controller 302 links the plurality of gaming machines 200 for feature event participation, among other functions, and such linkage is not restricted to gaming machines 200 at a single site, such as a single casino. Central controller 302 may optionally, through communications link 304 as known in the art, serve gaming machines and event displays distributed throughout a number of properties at different geographical locations including, for example, different locations within a city or different cities within a state. It is preferred that the central controller 302 be located at the same site as the event controller 330, although this is not required, given the current, high speed, broadband capabilities of telecommunications links.

Gaming machines 200 each, for example, may include a communications control unit 306 for interfacing each gaming machine 200 with the central controller 302. If the gaming machines 200 are of different types and/or of different manufacture, it may be necessary to provide gaming machine-specific interface cards in communications control unit 306.

Each gaming machine 200 also includes a game processor unit 308 operably coupled to central controller 302 through communications control unit 306. Each game processor unit 308 includes a microprocessor 310, memory 312, a network link 314 including a network card and drivers 316. The drivers 316 are, in turn, operably coupled to a video display 318, which may comprise, for example, a cathode ray tube (CRT), plasma display, liquid crystal display (LCD), and/or a display based on light emitting diodes (LED), possibly including a touchscreen input function. Audio outputs may also be incorporated into the gaming machine 200 and may be coordinated with a particular video display sequence, or may be separately initiated. Video display 318 may comprise a plurality of individual display segments 318*a*, 318*b*, etc., located either on a common screen display or on separate displays. Display segment 318*a* would typically comprise the game display, for example, the aforementioned five reel game, while another display segment 318*b* may comprise an event display 202. Gaming machines 200 also optionally include a clock 320, for example, for indicating through video display 318 the time remaining until the exhibition of an event. Alternatively, a timing function may be provided through the central controller 302, initiated by the event controller 330. A primary gaming unit credit meter 322 and event credit meter 324 (for display of event wagering credits accrued prior to the exhibition of an event) are also associated with each gaming machine 200. The individual components of the gaming machine as described above, or combinations thereof, may also be termed a gaming device.

The event controller 330 may be operable to initiate feature events in an automated manner and in accordance with preprogrammed parameters. For example, the event controller 330 may, and preferably is, programmed to schedule and initiate feature events, implement an event pay table or payout ratio distinct from that of a primary game, and provide information to event displays 202 (either on gaming machines 200 on a display segment 318*b* or on separate event displays 202, for example, associated with banks of gaming machines 200) between and/or during events as heretofore described.

It is preferable for security purposes that the overall framework of feature event qualification and wagering for a given event be installed into the event controller 330 (for example, on a CD-ROM) under appropriate security conditions, and that only certain variables not affecting payout ratios such as event scheduling and duration be accessible by casino operations personnel for alteration through input/output devices. Within the parameters of a payout ratio set for a feature event, it is, of course, possible to program the event controller 330 so that casino operations personnel may adjust the number and size of event awards and whether, for example, a nominal award will be paid to all entrants. Similarly, the event controller 330 may be programmed for administration of a feature event or series of feature events including a progressive jackpot payout, as well as to run a feature event in a pari-mutuel manner with respect to allocation of event funding.

Also linked to central controller 302 in real time is an accounting system 340 and a player information system 350, the two of which may be combined, as desired, in a single system. Accounting system 340 is employed to provide automated, real time accounting for a feature event administered by the event controller 330 through the central controller 302, while the player information system 350 provides stored, updated profiles of players with respect to credit status, money wagered, money won, games played, preferred games, etc., such information being updated with an integral player tracking function responsive to a player's smart card or other tracking method, as known in the art.

As will be clear to one of ordinary skill in the art, the foregoing description of a video display of the feature event may be implemented through a single display, or group of displays housed in a decorative casing or casings comprising the gaming machine chassis and coupled, directly or indirectly, to a common central controller 302 such as through a local area network (LAN) and/or through a wide area network (WAN). With the event wagering system 300 as illustrated in FIG. 3, multiple communication lines from the central controller 302 may be coupled to each gaming machine 200 to relay and modify display data in the multiple game display windows or segments. The communication lines may include, without limitation, electronic or other data transferring cable (including optical as well as electrical), radio frequency wave transmissions including cellular frequency transmissions as well as microwave, satellite dish frequencies, etc., phone lines (again both optical and electrical) and the like, such as is common with remote communication systems. If desired, the feature event mode may be run using the primary gaming machines merely to place entries, as remote video displays of the feature event and to receive awards, all other functions associated with the feature even being conducted by event controller 330, an approach which is particularly efficient if the feature event is conducted with a large group of players. Of course, if the feature event mode is run on a stand-alone basis, it may be conducted as needed on each of the gaming machines 200 by hardware and software included within each gaming machine 200 to minimize required communication with the central controller 302.

The game display and interaction as described herein may also be implemented through an Internet or Intranet server 360 as an Internet or Intranet display to be viewed by at least one Internet browser 370. In this way, connection to a feature event and accumulation of event credits, may be accomplished with only a connection to the Internet/Intranet server 360 through a conventional phone or other data transmission line, digital signal line (DSL), T-1 line, coaxial cable, fiber optic cable, or other connection known in the art. It will also be understood by those of ordinary skill in the art that enhanced bandwidth of digital wireless communications may render such technology suitable for some or all communications according to the present invention, particularly if such communications are encrypted. It will be further understood and appreciated by those of ordinary skill in the art that higher data transmission speeds may be useful for enhancing the sophistication and response of the display and interaction with the player. Even in an Internet embodiment, the game display may be housed in a decorative housing. One advantage to this embodiment, however, is that players may access an Internet game page from any location where an Internet connection and computer, or other Internet facilitator such as the so-called "WebTV" boxes or "Internet Appliances," are available. The expansion in the number of computers and number and speed of Internet connections in recent years increases opportunities for players to play from an ever-increasing number of remote sites. Thus, a personal computer or other Internet access-enabling device may serve as a gaming machine 200 of a widely distributed "bank" of gaming machines, not all of which would be located in a casino.

The central controller 302 may also be linked to a host computer 380 at the same or another site, host computer 380 controlling, by way of example, the entire computer network of a property or group of properties or another central controller overseeing another group of gaming machines configured to qualify players for event wagering for operation of additional events having an overlapping schedule with the events controlled by central controller 302.

Figure 4:
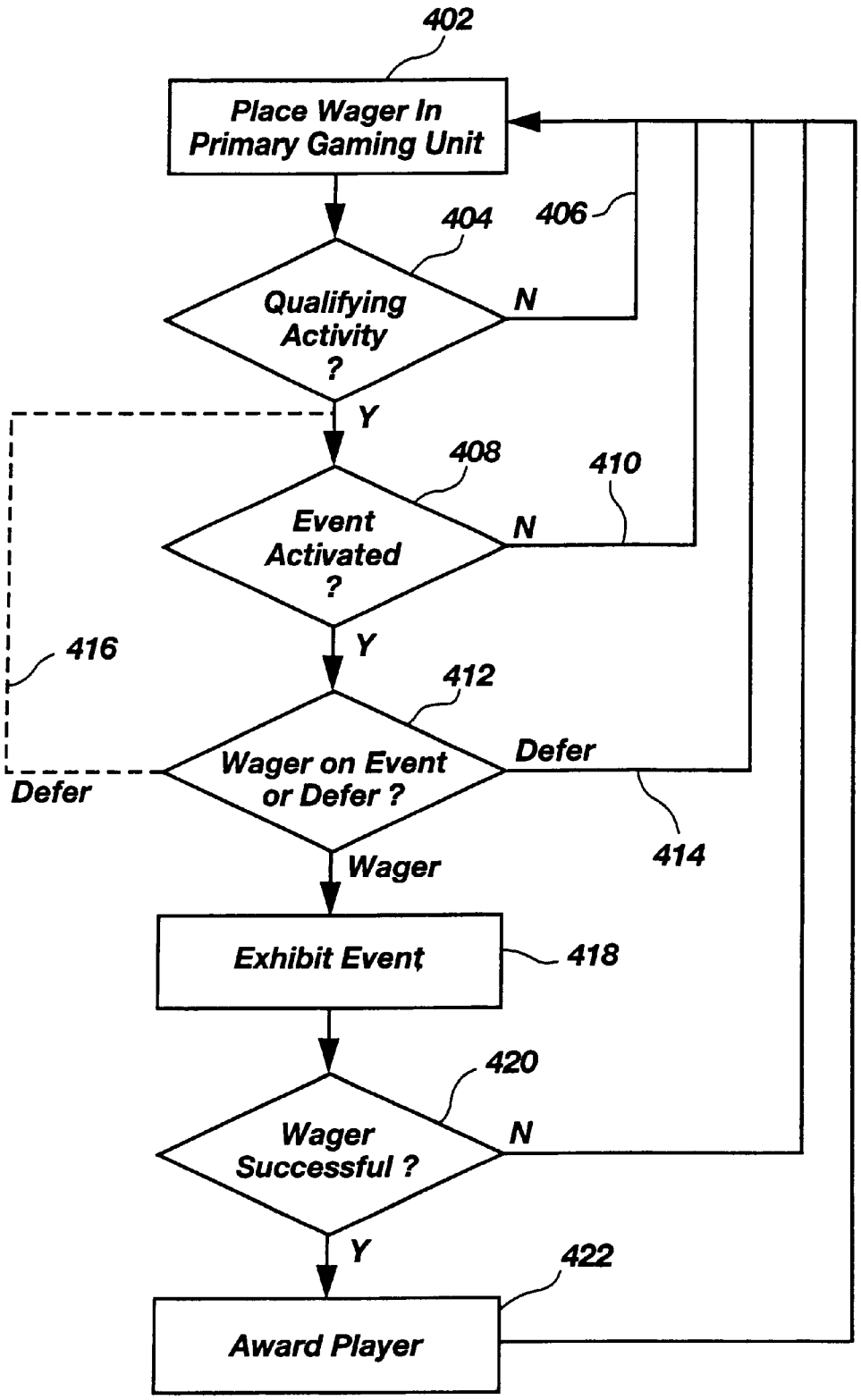
FIG. 4 is a flow chart depicting the logic used according to one embodiment of the invention.

Referring to FIG. 4, a method of gaming, including conducting a wagering event and qualification therefor is disclosed. The method described herein may be implemented on an individual gaming machine or, as currently preferred, it may be implemented on a plurality of gaming machines, which may be distributed over a wide variety of locations at the same or different properties, which are linked to and monitored by one or more computers, optionally including a dedicated event controller, through a network system.

According to one contemplated embodiment of the invention, a feature event qualification enhancement is incorporated within a traditional video reel type gaming machine which serves as the base or primary gaming unit. A wager is placed with the primary gaming unit as indicated at 402. Upon placement of a wager and the associated play of the primary game, it is determined whether a qualifying activity has occurred as indicated at 404. The qualifying activity, as described above, may include any of a number of predetermined activities including, but not limited to, generation of one or more predetermined outcomes in the primary gaming unit, the occurrence of an event symbol or a predetermined number or pattern of same on completion of a primary game, a sustained rate of wagering at a predetermined level for a predetermined period of time on the primary game, or the placement of a wager with the primary gaming unit of a predetermined value. While it is contemplated that no separate entry fee or buy in for feature event participation need be employed, it is possible that such may be implemented if desired by the gaming administrator to invite increased player participation and enhance revenues. Similarly, if so desired and as an additional feature, qualification could be accomplished through a simple "buy in" by the player if, for example, the player has been unsuccessful at qualifying through other specified activities.

If the qualifying activity has not occurred, the logic returns to step 402, as indicated at 406, wherein another wager is placed with the primary gaming unit. If the qualifying activity has occurred, it will be determined whether the feature event has been activated (or will be activated shortly) as shown at 408. As discussed previously, the feature event may be activated according to various criteria such as, for example, a predetermined schedule, or the qualification of a predetermined number of players when the method is implemented with a plurality of primary gaming units networked together.

If the feature event is not activated, the logic returns to the placement of a wager 402 as indicated by 410 wherein a player may again qualify for the feature event and possible enhance their participation opportunity as has been described above herein. If the feature event has been activated, the player may be queried as to whether they wish to "wager" their unit entry or feature event wagering points on the upcoming feature event or defer their wagering opportunity until the occurrence of a subsequent in time feature as is indicated at 412. In the case of deferral, as indicated at 414, the player may continue to place wagers with the primary gaming unit as desired. A player's decision to defer may be made be for the purpose of attempting to qualify multiple times for a later event and thus enhance the player's wagering opportunity. Those who ultimately enhance their wagering opportunities through continued play of the primary gaming unit may be allowed to wager a greater "sum" on a contestant or to wager on more than one contestant, or may be allowed to place "exacta" and "trifecta" type wagers if the event includes an appropriate type of contest. A cap, or limit may be placed on how many wagers may be placed by a qualified player in any particular event.

Alternatively and optionally, as indicated at 416, if a player defers their feature event wagering opportunity, they may wait until another feature event is activated without subsequent play of the primary or base game being required. Thus, if a qualified player's schedule will not allow for participation in the upcoming feature event he or she may defer until a later time. Such deferral may be accomplished by giving an event token, printing an event qualification ticket or by indicating on a player's smart card the status of qualification. Similarly, once a player has qualified, such as indicated at 404, they need not continue wagering in the primary game, but could wait for the activation of the feature event if so desired.

If the player desires to wager on the feature event, the entry and wager will be made for the player and the feature event will be exhibited as indicated at 418. The feature event may include any of a number of contests including those described above as a live contest, a reenacted live contest or a future feature contest. Once the feature event is complete, it will be determined whether any of the player entries in or "wagers" on the feature event were successful as shown at 420. Thus, the linked gaming machines may each report to a central monitoring computer, such as an event controller (see FIG. 3). The event controller then determines if each player meets criteria for an event payout based upon the event wager placed through the gaming machine and the results of the feature event. The event outcome, including the number of participants, winners, and payout awards are established and may be displayed on each gaming machine or through meter displays associated with a bank of gaming machines. The same information may be displayed on the event display 202 if so desired If a player's "wager" on the feature event was not successful, the process may begin over for that player by placing another wager with the primary gaming unit at 402. If a feature event wager was successful, the player placing the successful wager will be awarded according to the predetermined payout scheme as indicated at 422. After the award is made, the process starts over again at 402 such that the player may continue to wager with the primary gaming unit in hopes of qualifying for another upcoming feature event.

As noted previously, the present invention may be implemented with a bank of gaming machines at a single location or with gaming machines in multiple banks or otherwise distributed over a wide area, either within a single property or at multiple properties or casinos which are mutually remotely located. A stand-alone gaming machine may also be configured for participation in a feature event according to the present invention.

Variations may be implemented as to what effect, if any, the primary game or wagers placed thereon have upon the feature event. For example, and as described above, the feature event may be independent of the primary game, either exhibiting its own random outcome or that of an actual event. The feature event may have a random outcome with award amounts adjusted per the number and/or value of entries. The feature event may have a random outcome but with odds adjusted per the number and/or value of the entries. The progress and/or outcome of the feature event may be based in whole or in part on outcomes of games played after commencement of the feature event. In such an event, an award might be split among those gaming machines which caused the winning competitor to win, preferably proportionate to their respective contributions. A variation of this shared winning concept is that, for certain feature wins, all participating players (for example, apportioned according to win, loss or play rate) would receive some award--the largest share going, for example, to the player triggering the feature event. Of course, it will be understood by those of ordinary skill in the art that the aforementioned alternatives and indeed any form of the game of the present invention may be implemented, when required, in accordance with applicable gaming regulations of a jurisdiction in which the game is played.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

What is claimed is:

1. A method of conducting a gaming activity comprising:

receiving a wager from a player, the wager associated with a game;

generating an outcome of the game;

qualifying the player for at least one opportunity for at least one award associated with at least one feature event, the at least one feature event comprising at least one of a live contest, a reenacted live contest, and a future feature contest, wherein qualification for the at least one opportunity is responsive, at least in part, to an activity associated with play of the game; and permitting the player to enhance the at least one opportunity based on continued play of the game subsequent to qualifying the player.

2. A method according to claim 1, wherein permitting the player to enhance the at least one opportunity comprises allowing the player an opportunity to accrue more credits associated with the at least one feature event.

3. A method according to claim 1, wherein permitting the player to enhance the at least one opportunity comprises allowing the player an opportunity to accrue more unit entries associated with the at least one feature event.

4. A method according to claim 1, wherein permitting the player to enhance the at least one opportunity comprises allowing the player an opportunity to accrue more wagering points associated with the at least one feature event.

5. A method according to claim 1, wherein permitting the player to enhance the at least one opportunity comprises allowing the player to attempt to qualify multiple times for the at least one feature event prior to a start of the at least one feature event.

6. A method according to claim 1, further comprising displaying the at least one feature event on a display screen.

7. A method according to claim 6, wherein the display screen is separate from a gaming unit on which the player plays the game.

8. A method according to claim 1, wherein qualifying the player for the at least one opportunity further comprises qualifying the player for a plurality of opportunities for the at least one award.

9. A method according to claim 1, wherein the at least one feature event comprises a plurality of feature events.

10. A method according to claim 9, further comprising allowing the player to defer the at least one opportunity from a first feature event of the plurality of feature events to a second feature event of the plurality of feature events.

11. A method according to claim 9, further comprising activating each feature event in the plurality of feature events at time intervals.

12. A method according to claim 1, wherein the player plays to the game at a gaming unit operatively networked with a plurality of other gaming units, each gaming unit of the plurality of other gaming units configured for play of the game;

wherein the method further comprises qualifying at least another player for at least one opportunity, wherein the another player plays the game at one gaming unit of the plurality of other gaming, wherein qualification of the another player is responsive, at least in part, to an activity associated with play of the game by the another player.

13. A method according to claim 12, further comprising activating the at least one feature event upon qualification of a number of players from a plurality of players at the plurality of gaming units.

14. A method according to claim 12, further comprising configuring at least one award from the at least one feature event as a pari-mutuel award.

15. A method according to claim 12, wherein the gaming unit and at least one of the plurality of other gaming units are remotely located from each other.

16. A method according to claim 12, wherein a first group of the gaming unit and the plurality of other gaming units is at a first location, and a second group of the gaming unit and the plurality of other gaming units is at a second location remote from the first location;

wherein the at least one feature event includes a plurality of contestants;

wherein players at the first location are associated with a first contestant of the plurality of contestants;

wherein players at the second location are associated with a second contestant of the plurality of contestants.

17. A method according to claim 1, wherein the at least one feature event comprises a race having a plurality of race contestants.

18. A method according to claim 17, further comprising allowing the player to select at least one of the plurality of race contestants.

19. A method according to claim 17, further comprising allowing the player to select multiple race contestants of the plurality of race contestants.

20. A method according to claim 17, further comprising allowing the player to select an order of finish of the plurality of race contestants.

21. A method according to claim 1, further comprising activating the at least one feature event at a scheduled time.

22. A method according to claim 1, further comprising activating the at least one feature event responsive to at least one outcome of the game selected from a plurality of possible outcomes.

23. A method according to claim 1, further comprising activating the at least one feature event responsive to a sustained level of wager, rapidity of wager, or cumulative level of multiple wagers associated with the game.

24. A method according to claim 1, receiving a wager from the player associated with the at least one feature event, the wager associated with the at least one feature event independent of continued play of the game.

25. A method according to claim 1, wherein the activity associated with play of the game includes generating at least one outcome selected from a plurality of possible outcomes of the game.

26. A method according to claim 1, wherein the activity associated with play of the game includes receiving a wager associated with the game of a selected value from the player.

27. A method according to claim 1, wherein the activity associated with play of the game includes receiving a wager associated with the game from the player.

28. A method according to claim 1, wherein the at least one opportunity includes an opportunity for the player to place a wager remotely via a personal computer coupled to the Internet.

29. A method according to claim 1, wherein the game comprises at least one of a poker game, a blackjack game, a slots game, a bingo game, and a keno game.

30. A method of conducting a gaming activity comprising:

receiving a wager from a player, the wager associated with a game;

generating an outcome of the game;

qualifying the player for at least one opportunity for an award from a plurality of feature events, wherein at least one feature event of the plurality of feature events comprises at least one of a live contest, a reenacted live contest, and a future feature contest, wherein qualification for the at least one opportunity is responsive, at least in part, to an activity associated with play of the game;

allowing the player to defer the at least one opportunity from a first feature event of the plurality of feature events to a second feature event of the plurality of feature events.

31. A method according to claim 30, further comprising receiving at least an additional wager from the player between the first feature event and the second feature event, the at least an additional wager associated with continued play of the game; and generating at least an additional outcome of the game between the first feature event and the second feature event.

32. A method according to claim 30, wherein allowing the player to defer the at least one opportunity from the first feature event to the second feature event comprises providing an event token to the player.

33. A method according to claim 32, wherein the event token is indicative of an event wager.

34. A method according to claim 30, wherein allowing the player to defer the at least one opportunity from the first feature event to the second feature event comprises providing an event qualification ticket to the player.

35. A method according to claim 34, wherein the qualification ticket includes event wager information.

36. A method according to claim 30, wherein allowing the player to defer the at least one opportunity from the first feature event to the second feature event comprises indicating event qualification on a smart card of the player.

37. A method according to claim 36, further comprising indicating an event wager on the smart card of the player.

38. A method according to claim 30, wherein the game comprises at least one of a poker game, a blackjack game, a slots game, a bingo game, and a keno game.

39. A method of conducting a gaming activity comprising:

receiving a wager from a player of a plurality of players, the wager associated with a game;

generating an outcome of the game;

qualifying the player for at least one opportunity for an award from a plurality of feature events, wherein at least one feature event of the plurality of feature events comprises at least one of a live contest, a reenacted live contest, and a future feature contest, wherein qualification for the at least one opportunity is responsive, at least in part, to an activity associated with play of the game; and activating the at least one feature event upon qualification of a number of players in the plurality of players, wherein the number of players is at least two.

40. A method according to claim 39, wherein the activity associated with play of the game includes generating at least one outcome selected from a plurality of possible outcomes of the game.

41. A method according to claim 39, wherein the activity associated with play of the game includes receiving a wager associated with the game of a selected value from the player.

42. A method according to claim 39, wherein the activity associated with play of the game includes receiving a wager associated with the game from the player.

43. A method according to claim 39, wherein the game comprises at least one of a poker game, a blackjack game, a slots game, a bingo game, and a keno game.

44. A gaming device, comprising:

a wager input device to receive a wager from a player;

an input device to allow the player to make an input selection;

a controller operatively coupled to the wager input device and the input device, the controller comprising a processor and a memory operatively coupled to the processor, the controller being programmed to allow the player to make a wager associated with a game via the wager input device, the controller being programmed to allow the player to play the game, the controller being programmed to determine an outcome of the game, the controller being programmed to qualify the player for at least one opportunity for an award from a plurality of feature events, at least one feature event of the plurality of feature events comprising at least one of a live contest, a reenacted live contest, and a future feature contest, wherein qualification for the at least one opportunity is responsive, at least in part, to a predetermined activity associated with play of the game, and the controller being programmed to permit the player to enhance the at least one opportunity based on continued play of the game subsequent to qualifying the player.

45. A gaming device according to claim 44, wherein the controller is programmed to allow the player an opportunity to accrue more credits associated with the at least one feature event subsequent to qualifying the player.

46. A gaming device according to claim 44, wherein the controller is configured to allow the player an opportunity to accrue more unit entries associated with the at least one feature event subsequent to qualifying the player.

47. A gaming device according to claim 44, wherein the controller is programmed to allow the player an opportunity to accrue more wagering points associated with the at least one feature event subsequent to qualifying the player.

48. A gaming device according to claim 44, wherein the controller is configured to allow the player to continue to play the game prior to a start of the at least one feature event subsequent to qualifying the player.

49. A gaming device according to claim 44, wherein the controller is configured to allow the player to attempt to qualify multiple times for the at least one feature event prior to a start of the at least one feature event.

50. A gaming device according to claim 44, further comprising a game display device operatively coupled to the controller;

wherein the controller is programmed to display the outcome of the game via the game display device.

51. A gaming device according to claim 44, further comprising a feature event display device operatively coupled to the controller;

wherein the controller is programmed to display feature events via the feature event display device.

52. A gaming device according to claim 51, wherein the controller is programmed to activate the at least one feature event.

53. A gaming device according to claim 44, further comprising a communications device operatively coupled to the controller and to a network;

wherein the controller is programmed to send feature event entry information associated with the player to a central controller via the communications device, wherein the controller is operatively coupled to the network.

54. A gaming device according to claim 53, wherein the controller is programmed to receive feature event payout information associated with the player from the central controller via the communications device.

55. A gaming device according to claim 44, wherein the game comprises at least one of a poker game, a blackjack game, a slots game, a bingo game, and a keno game.

56. A gaming device, comprising:

a wager input device to receive a wager from a player;

an input device to allow the player to make an input selection;

a controller operatively coupled to the wager input device and the input device, the controller comprising a processor and a memory operatively coupled to the processor, the controller being programmed to allow the player to make a wager associated with a game via the wager input device, the controller being programmed to allow the player to play the game, the controller being programmed to determine an outcome of the game, the controller being programmed to qualify the player for at least one opportunity for an award from a plurality of feature events, at least one feature event of the plurality of feature events comprising at least one of a live contest, a reenacted live contest, and a future feature contest, wherein qualification for the at least one opportunity is responsive, at least in part, to a predetermined activity associated with play of the game, and the controller being programmed to allow the player to defer the at least one opportunity from a first feature event of the plurality of feature events to a second feature event of the plurality of feature events.

57. A gaming device according to claim 56, wherein the controller is configured to receive at least an additional wager from the player between the first feature event and the second feature event, the at least an additional wager associated with continued play of the game; and wherein the controller is configured to generate at least an additional outcome of the game between the first feature event and the second feature event.

58. A gaming device according to claim 56, wherein the controller is configured to cause the gaming device to provide an event token to the player.

59. A gaming device according to claim 58, wherein the event token is indicative of an event wager.

60. A gaming device according to claim 56, wherein the controller is configured to cause the gaming device to provide an event qualification ticket to the player.

61. A gaming device according to claim 60, wherein the qualification ticket includes event wager information.

62. A gaming device according to claim 56, wherein the controller is configured to cause the gaming device to indicate event qualification on a smart card of the player.

63. A gaming device according to claim 62, wherein the controller is configured to cause the gaming device to indicate an event wager on the smart card of the player.

64. A gaming device according to claim 56, wherein the game comprises at least one of a poker game, a blackjack game, a slots game, a bingo game, and a keno game.

65. A gaming system, comprising:

a plurality of individual gaming units, at least one individual gaming unit of the plurality of individual gaming units comprising:

a wager input device to receive a wager from a player of a plurality of players;

an input device to allow the player to make an input selection;

a gaming unit controller operatively coupled to the wager input device and the input device, the gaming unit controller comprising a gaming unit processor and a gaming unit memory operatively coupled to the gaming unit processor, the gaming unit controller being programmed to allow the player to make a wager via the wager input device, the gaming unit controller being programmed to allow the player to play a game, the gaming unit controller being programmed to determine an outcome of the game, the gaming unit controller being programmed to qualify the player for at least one opportunity for an award from a plurality of feature events, at least one feature event of the plurality of feature events comprising at least one of a live contest, a reenacted live contest, and a future feature contest, wherein qualification for the at least one opportunity is responsive, at least in part, to an activity associated with play of the game, the gaming unit controller being programmed to permit the player to enhance the at least one opportunity based on continued play of the game subsequent to qualification of the player; and an event controller operatively coupled to the plurality of gaming units, the event controller being configured to initiate the at least one feature event.

66. A gaming system according to claim 65, wherein the at least one individual gaming unit of the plurality of individual gaming units further comprises an event display operatively coupled to the gaming unit controller; and wherein the event controller is configured to cause the at least one feature event to be displayed on the event display of the at least one individual gaming unit.

67. A gaming system according to claim 66, wherein the at least one individual gaming unit of the plurality of individual gaming units further comprises a game display unit operatively coupled to the gaming unit controller, wherein the game display unit is separate from the event display; and wherein the gaming unit controller is configured to display the outcome of the game via the game display unit.

68. A gaming system according to claim 66, wherein the at least one individual gaming unit of the plurality of individual gaming units further comprises a game display unit operatively coupled to the gaming unit controller, the game display unit including a display screen; and wherein the display screen comprises the event display.

69. A gaming system according to claim 65, further comprising an event display communicatively coupled to the event controller, wherein the event display is separate from the plurality of individual gaming units; and wherein the event controller is configured to cause the at least one feature event to be displayed on the event display.

70. A gaming system according to claim 65, wherein the game comprises at least one of a poker game, a blackjack game, a slots game, a bingo game, and a keno game.

71. A gaming system, comprising:

a plurality of individual gaming units, at least one individual gaming unit of the plurality of individual gaming units comprising:

a wager input device to receive a wager from a player of a plurality of players;

an input device to allow the player to make an input selection;

a gaming unit controller operatively coupled to the wager input device and the input device, the gaming unit controller comprising a gaming unit processor and a gaming unit memory operatively coupled to the gaming unit processor, the gaming unit controller being programmed to allow the player to make a wager via the wager input device, the gaming unit controller being programmed to allow the player to play a game, the gaming unit controller being programmed to determine an outcome of the game, the gaming unit controller being programmed to qualify the player for at least one opportunity for an award from a plurality of feature events, at least one feature event of the plurality of feature events comprising at least one of a live contest, a reenacted live contest, and a future feature contest, wherein qualification for the at least one opportunity is responsive, at least in part, to an activity associated with play of the game, the gaming unit controller being programmed to allow the player to defer the at least one opportunity from a first feature event of the plurality of feature events to a second feature event of the plurality of feature events; and an event controller operatively coupled to the plurality of gaming units, the event controller being configured to initiate the at least one feature event.

72. A gaming system according to claim 71, wherein the at least one individual gaming unit of the plurality of individual gaming units further comprises an event display operatively coupled to the gaming unit controller; and wherein the event controller is configured to cause the at least one feature event to be displayed on the event display of the at least one individual gaming unit.

73. A gaming system according to claim 72, wherein the at least one individual gaming unit of the plurality of individual gaming units further comprises a game display unit operatively coupled to the gaming unit controller, wherein the game display unit is separate from the event display; and wherein the gaming unit controller is configured to display the outcome of the game via the game display unit.

74. A gaming system according to claim 72, wherein the at least one individual gaming unit of the plurality of individual gaming units further comprises a game display unit operatively coupled to the gaming unit controller, the game display unit including a display screen; and wherein the display screen comprises the event display.

75. A gaming system according to claim 71, further comprising an event display communicatively coupled to the event controller, wherein the event display is separate from the plurality of individual gaming units; and wherein the event controller is configured to cause the at least one feature event to be displayed on the event display.

76. A gaming system according to claim 71, wherein the game comprises at least one of a poker game, a blackjack game, a slots game, a bingo game, and a keno game.

77. A gaming system, comprising:

a plurality of individual gaming units, at least one individual gaming unit of the plurality of individual gaming units comprising:

a wager input device to receive a wager from a player of a plurality of players;

an input device to allow the player to make an input selection;

a gaming unit controller operatively coupled to the wager input device and the input device, the gaming unit controller comprising a gaming unit processor and a gaming unit memory operatively coupled to the gaming unit processor, the gaming unit controller being programmed to allow the player to make a wager via the wager input device, the gaming unit controller being programmed to allow the player to play a game, the gaming unit controller being programmed to determine an outcome of the game, the gaming unit controller being programmed to qualify the player for at least one opportunity for an award from a plurality of feature events, at least one feature event of the plurality of feature events comprising at least one of a live contest, a reenacted live contest, and a future feature contest, wherein qualification for the at least one opportunity is responsive, at least in part, to an activity associated with play of the game, and an event controller operatively coupled to the plurality of gaming units, the event controller being configured to activate the at least one feature event upon qualification of a number of players in the plurality of players, wherein the number of players is at least two.

* * * * *